US005666765A

United States Patent [19]

Sarner et al.

[11] Patent Number: 5,666,765

[45] Date of Patent: Sep. 16, 1997

[54] SUITCASE VOTING BOOTH WITH ACCESS FOR HANDICAPPED PERSONS

[75] Inventors: Larry W. Sarner; Lee S. Smith, both of Loveland; Kenneth B. Malpass, Boulder, all of Colo.

[73] Assignee: Mark Voting Systems, Inc., Loveland, Colo.

[21] Appl. No.: 496,854

[22] Filed: Jun. 20, 1995

[51] Int. Cl.[6] ..... A47F 10/00

[52] U.S. Cl. ..... 52/36.1; 235/51; 248/188; 312/140.2; 312/223.2; 312/351.9; 312/902; 434/306

[58] Field of Search ..... 52/36.1; 248/129, 248/130, 135, 136, 439, 917, 188; 312/22, 23, 140.2, 258, 223.2, 351.9, 902; 280/37; 364/409; 235/51, 54 F; 434/306

[56] References Cited

U.S. PATENT DOCUMENTS

| | | | |
|---|---|---|---|
| 3,620,587 | 11/1971 | Ahmann | 312/223 |
| 3,806,219 | 4/1974 | Ahmann | 312/223 |
| 4,451,728 | 5/1984 | McKay et al. | 235/50 R |
| 4,569,564 | 2/1986 | Ahmann | 312/259 |
| 4,712,757 | 12/1987 | Ahmann | 248/188 |
| 4,854,652 | 8/1989 | Ahmann | 312/140.2 |

*Primary Examiner*—Christopher T. Kent
*Attorney, Agent, or Firm*—Holme Roberts & Owen

[57] ABSTRACT

A lightweight portable voting booth (20) includes a bivalve case (22), a declined electronic voting panel (24) and a support base (26) that permit full frontal access by a wheelchair-bound person (30). The booth (20) can be packed into the case (22) for transport and storage.

25 Claims, 6 Drawing Sheets

SUITCASE VOTING BOOTH WITH ACCESS FOR HANDICAPPED PERSONS

BACKGROUND OF THE INVENTION

1. Field of the Invention

The present invention pertains to the field of portable voting booths and, more particularly, voting booths that can be accessed by wheelchair-bound persons. Still more specifically, the voting booth folds into a configuration that resembles a suitcase, yet readily unpacks to an open configuration that is fully accessible by handicapped persons.

2. Description of the Prior Art

Portable voting booths are known in the art and have been used to equip precinct voting locations in elections. As used herein, the term "portable voting booth" means a voting booth that is light enough to be carried by hand and can be folded into a compact, stackable structure for transportation and storage. Excluded from this definition are bulkier and heavier non-folding cart-mounted booths that occupy more space and defy easy handling in transport. The disclosure of U.S. Pat. No. 5,190,302 is used to exemplify a cart-mounted booth that is excluded from the present definition of a portable booth. FIG. 2 thereof depicts a wheelchair-bound person accessing the booth from a full frontal position, however, the booth cannot be folded for easy transport. The weight and bulk of the cart mounted CRT display system significantly exacerbates logistical problems in an election. The booth requires special attention and preparation prior to shipment from a central storage location. A relatively large amount of storage space is required to store hundreds or thousands of these booths between elections. A relatively large number of workers and a corresponding fleet of vehicles are required to disperse these booths from the central storage location.

U.S. Pat. No. 4,641,240 discloses another non-folding booth, but it should be noted that a wheelchair-bound person can only access the ballot in an awkward position from the side of the wheelchair because a footrest precludes frontal access.

Truly portable voting booths offer numerous logistical advantages over heavier and bulkier booths, however, these advantages are often obtained as a result of design compromises that produce a less than fully functional booth. Specifically, handicapped persons have difficulty in accessing prior portable booths.

U.S. Pat. No. 4,660,904 to Stephens discloses a non-electronic portable voting booth and lectern that folds into a suitcase-like configuration, however, the features of this booth deny full access to handicapped persons. The lectern legs are not wide enough to permit frontal access by a wheelchair-bound person. Additionally, a wheelchair-bound person has difficulty in seeing and writing on the writing surface, as the writing surface is not inclined and would not be presented to the face of the person. The lectern, though portable, is not integrated with an electronic balloting system. Problems relating to frontal blockage, privacy, and balloting surface access are increased, as can be observed in U.S. Pat. No. 5,275,365, where the portable fold-up design incorporates an electronic balloting system.

A true need exists for a portable electronic voting booth that permits handicapped persons frontal access to a private ballot casting surface area.

SUMMARY OF THE INVENTION

The present invention overcomes the problems that are outlined above by providing a truly portable, lightweight, electronic voting booth that permits wheelchair-bound persons frontal access to a private ballot casting area. The booth can be folded into a suitcase-like configuration for ease of transport to remote precinct voting stations.

The voting booth includes a bivalve case having a pair of hingedly connected shell members. The case presents an interior compartment, and has an open configuration that may be used for voting purposes, and a closed suitcase-like configuration that may be used for storage purposes. A voting panel is coupled with the bivalve case and has dimensions corresponding to the interior compartment for receipt of the panel within the compartment when the case is in the closed configuration. The voting panel presents a frontal access position and a declined ballot-casting surface. A voting panel support base is pivotally connected to a plurality of vertically rising legs. The legs are locked into fixed positions along an arc of travel for use in the open case configuration as the case is made ready for voting. The legs are pivoted to a position within a corresponding case compartment as the case is made ready for storage. The legs are separated by a sufficient width distance across the voting panel to permit the front of a wheelchair to pass between the legs. The ballot casting surface preferably slopes downwardly towards a front portion of the voting panel for presentment of the surface to a seated person at an angle ranging from thirty-five to fifty degrees relative to horizontal. Similarly, the upper shell member is preferably declined towards the front at all angle ranging from five to fifteen degrees down from vertical. This angle enhances the visibility of voting instructions to a wheelchair-bound person without impairing the visibility to a person who is standing to cast votes.

In preferred embodiments, a sliding latch mechanism engages and disengages from the voting panel as the lower shell member is moved between the open configuration and the closed configuration. Sliding motion of the voting panel between the locked and unlocked positions is induced by rotation of the lower shell member as the shell member is moved between the open and closed configurations.

At least one hinge connects the shell members and the voting panel. At least one of the support legs includes a latch mechanism for coupling with the lower shell member. This lower shell member in the latched configuration serves as a brace to stabilize the entire booth as needed by acting in compression, tension, or shear against the leg with which it is coupled.

The voting panel preferably includes an interactive electronic display for indicating ballot selections or votes. The display is preferably driven by a controller that exists at a central election judges station, which finally records and tallies the votes of each person casting votes in the booth. The interactive nature of the display preferably includes a light emitting diode ("LED") for every ballot option, and the controller energizes the LED's to light the same as an indication that a specific ballot option has been selected.

A rod and curtain assembly is preferably connected to the upper shell member to assure privacy as the votes are cast. This rod and curtain assembly can be taken down to a configuration that packs within the shell. Thus, the voting booth is fully self-contained in a closed configuration made ready for transport. The self-contained booth preferably weighs less than about fifty pounds, and more preferably less than about thirty-five pounds. In the latter case, the voting panel is preferably made of a special laminate utilizing a printed circuit board as a skin that is bonded to a shear bearing core. The shear bearing core is preferably made of a honeycombed metal, polymer material, or foam to obtain a significant weight reduction.

BRIEF DESCRIPTION OF THE DRAWINGS

FIG. 2;

DETAILED DESCRIPTION OF THE PREFERRED EMBODIMENT

Figure 1:
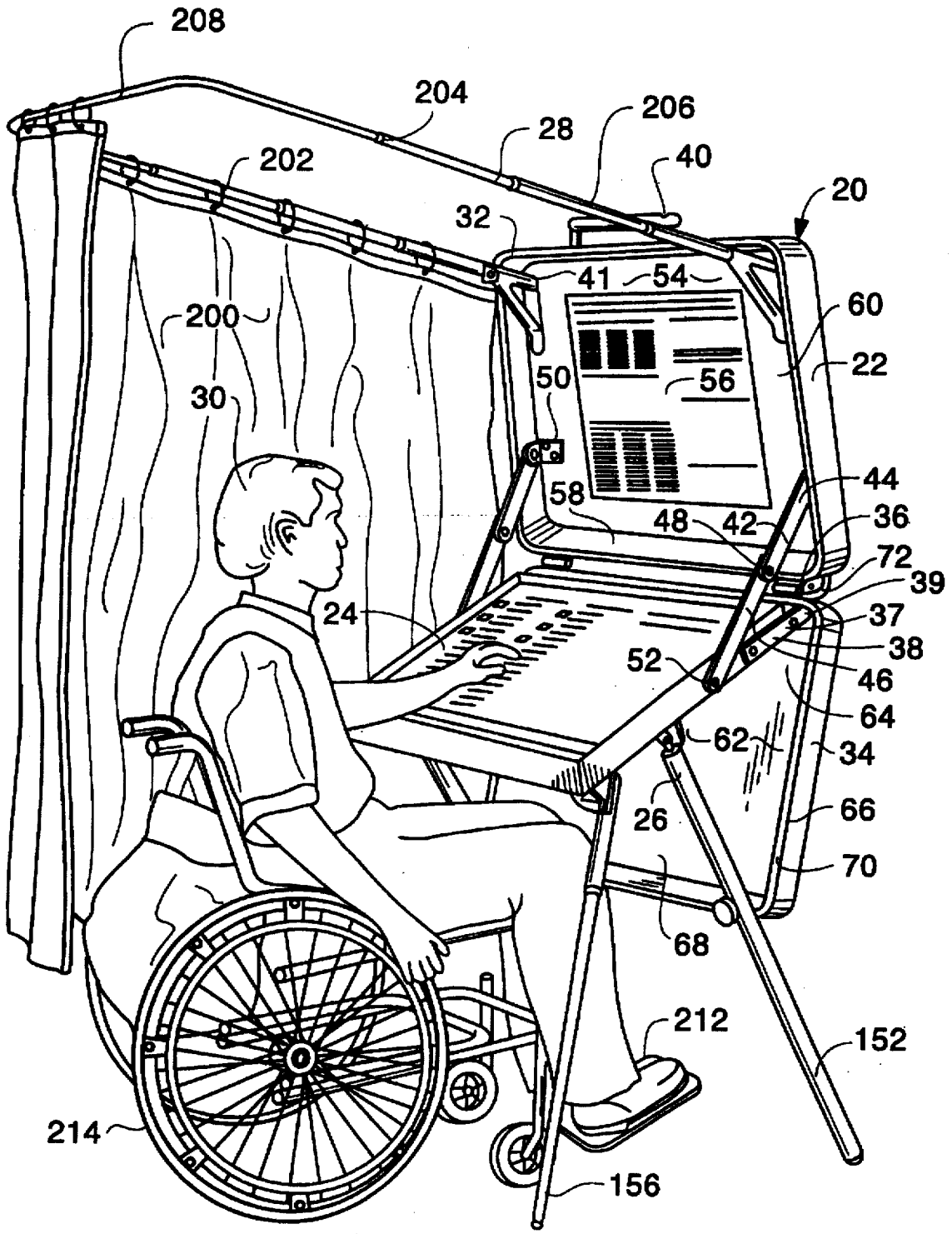
FIG. 1 depicts a right front perspective view of a handicapped-accessible portable voting booth according to the present invention in an unpacked configuration made ready for an election.

FIG. 1 depicts voting booth 20 having bivalve case 22, rectangular declined voting panel 24, support base 26, and curtain rod assembly 28. Booth 20 is depicted as being accessed by a wheelchair-bound person 30 who is facing the front of booth 20.

Case 22 includes an upper shell member 32 and a lower shell member 34, which are preferably made of a molded high impact-resistant synthetic resin, e.g., acrylonitrile butadiene styrene ("ABS") resin or fiberglass. Members 32 and 34 are connected at their respective rearward ends by a first pair of metal hinges, e.g., hinge 36. A second pair of metal hinges, e.g., hinge 37, have a first elongated segment 38 bolted to panel 24 and a second segment angular segment 30 that is riveted to lower shell member 34. Accordingly, hinge 36 and hinge 37 pivot around different rotational axes.

Upper shell member 32 has a carry handle 40 and a pair of aluminum brackets, e.g., bracket 41, for receiving and supporting rod and curtain assembly 28. Member 32 is connected to a pair of locking spring metal pivot strap arms, e.g., arm 42. Arm 42 includes a first segment 44 and a second segment 46, which are centrally joined for rotation around rivet 48. Segments 44 and 46 preferably include a conventional spring detent assembly (not depicted) in their corresponding ends proximal to rivet 48. The detent assembly utilizes the spring force of the metal to detachably lock arm 42 in the extended position as shown in FIG. 1. First section 44 is rotatably pinned to shell member 32 at a right angle connector that forms a mirror image with respect to connector 50 at a position remote from rivet 48. In turn, angle connector 50 is riveted to shell member 32. Second section 46 is rotatably pinned to voting panel 24 at pin 52. Member 32 includes a central substantially planar rear wall 54. A detachable sheet 56 of printed indicia comprising balloting instructions and information is fastened to wall 54. Wall 54 is declined frontwardly from vertical at a preferred angle ranging from about five to fifteen degrees. This low angle of declination permits viewing of sheet 56 by a seated person 30, as well as a person standing in place of person 30. Wall 54 is integrally formed with a forwardly raised perimeter lip 58 to define an upper shell compartment area 60 between lip 58 and wall 54. The forwardmost surface of lip 58 is preferably surrounded by an elastomeric seal or gasket.

Lower shell member 34 includes a lower rear shell wall 62. Wall 62 is also integrally formed with a forwardly raised lower shell perimeter lip 66 to define a lower shell compartment area 68. Lip 66 has dimensions corresponding with lip 60 to meet with the elastomeric seal thereof along forward surface 70. The rearward exterior surface of each shell member 32 and 34 is provided with a pair of wheels, e.g., wheel 72, for rolling of booth 20 in transport. Each pair of wheels is separated by a different width across voting panel 24 to permit opening of case 22 as depicted in FIG. 1 without interference caused by collision of the wheels of the respective shell members.

Figure 2:
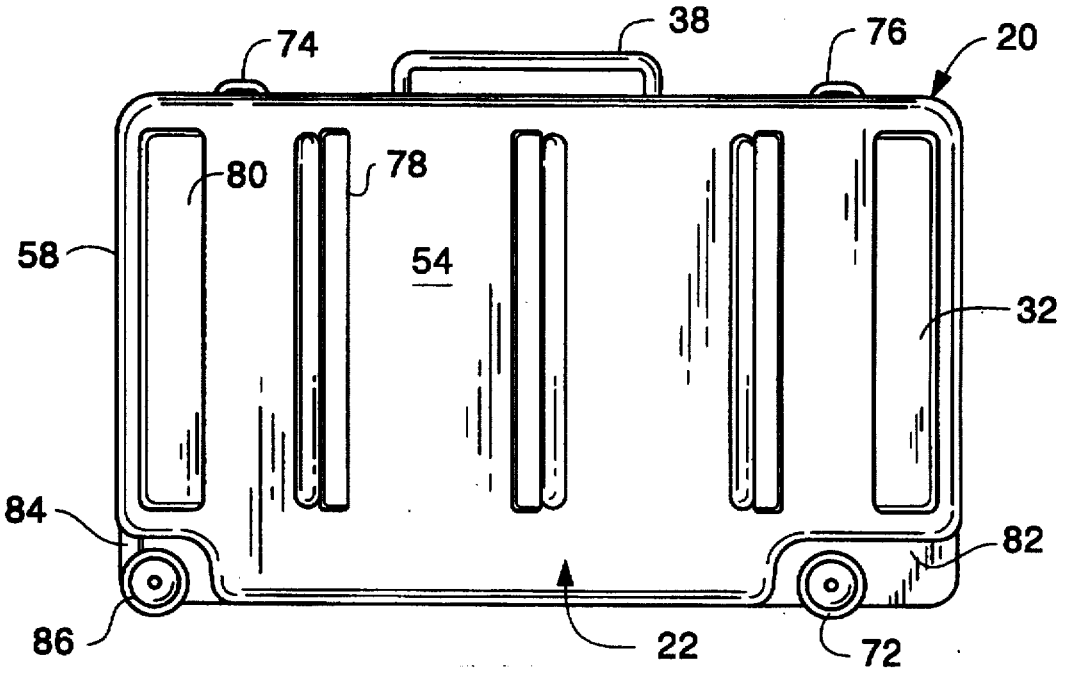
FIG. 2 depicts a rear elevational view of the FIG. 1 booth in a compact suitcase-like configuration made ready for transport and storage.

FIG. 2 depicts booth 20 folded into a suitcase-like configuration that is sealed by top latches 74 and 76. Rearward wall 54 is preferably provided with a plurality of forwardly raised stiffening ribs, e.g., ribs 78 and 80, that extend longitudinally along the height of shell member 32. Wheel wells 82 and 84 are recessed forwardly a sufficient distance such that wheels 72 and 86 preferably do not extend rearwardly beyond the rearward surface of wall 54.

Figure 3:
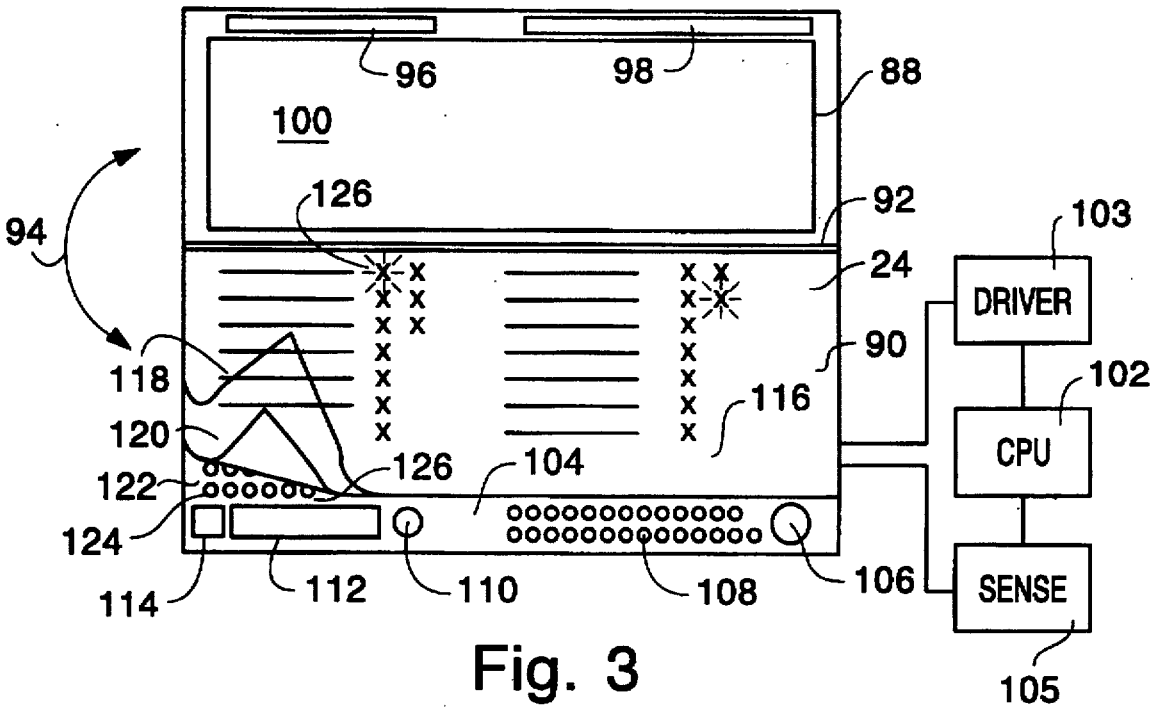
FIG. 3 is depicts a top plan view of a voting panel for use in the booth of FIG. 1 with a logic block diagram depiction of interior and exterior circuitry.

FIG. 3 depicts a top plan view of voting panel 24 including panel lid 88 and panel body 90. Lid 88 is preferably made of aluminum or ABS plastic, and is rearwardly coupled to body 90 by a single hinge 92. Lid 88 is depicted in an uppermost position relative to arc 94. Lid 88 can also be pivoted along arc 94 to lie flat against body 90 where the respective openings, i.e., openings 96, 98, and 100, permit access to body 90. Body 90 is electronically operated and controlled by a central processing unit ("CPU") 102, which is operably connected to driver 103, and switch status sensory circuit 105. Body 90 includes a lower button and display area 104 that includes a cast-vote button 106, alphanumeric buttons 108, write-in ballot button 110, liquid crystal display 112, and a help button 114. Upper body area 116 is located just above lower body area 104. Area 116 includes a series of layers that are rearwardly affixed to panel 24. As depicted in FIG. 3, these layers include flexible transparent polycarbonate sheet 118, paper ballot sheet 120, and light emitting diode ("LED") indicator switch panel 122 including a plurality of membrane LED switches, e.g., LED switch 124, formed in rows and columns. CPU 102 is operably connected to panel 122 for the lighting of selected LED switches, e.g., LED switch 126, after they are depressed. The energized LEDs correspond to ballot choices on ballot sheet 120. CPU 102 including driver 103 is preferably networked to a plurality of booths 20. Sensory circuit 105 is preferably found within panel 24.

Figure 4:
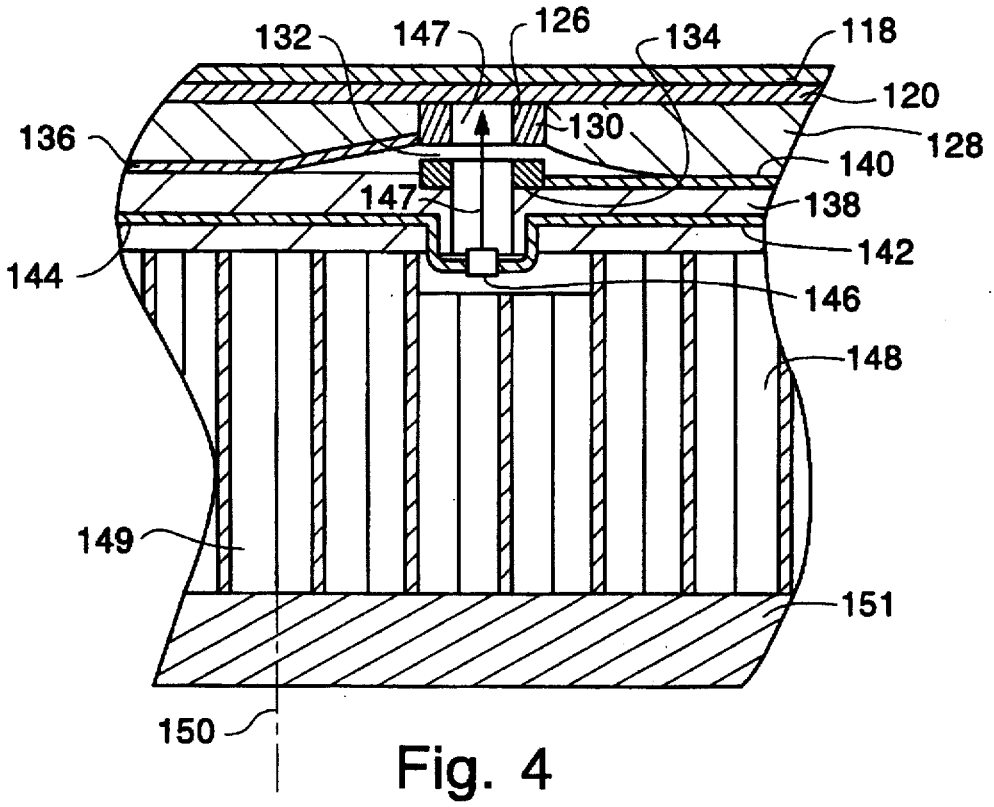
FIG. 4 is a partial elevational section view depicting a layered construction of the voting panel of FIG. 3.

FIG. 4 depicts a partial sectional view of voting panel 24 along a cut taken through exemplary LED switch 126. Switch 126 lies beneath transparent polycarbonate layer 118 and paper ballot sheet 120. Elastomeric web 128 is preferably made of neoprene and tapers towards a central aperture that contains upper metal ring 130. Gap 132 normally separates upper ring 130 from lower metal ring 134 because web 128 biases ring 130 to the position depicted in FIG. 4. Web-mounted sensory lead 136 connects ring 130 and sensory circuit 105.

Printed circuit board 138 underlies web 128. Board 138 includes a signal or sensory plane that holds lower ring 134 and board-mounted sensory lead 140. Board 138 also includes a power plane that includes power lead 142 and ground 144, which contact a central LED 146. Alternatively, lead 142 may be provided on the sensory plane. LED is centrally positioned to emit light along optical pathway 147. The light travelling along pathway 147 will impinge on the portion of ballot sheet 120 that overlies pathway 147. Lead 142 is energized by driver 103 at the direction of CPU 102. Leads 136 and 140 are operably connected to sensory circuit 105.

Board 138 is preferably adhered to a shear core 148, which is preferably made of honeycombed aluminum, but may also be made of styrofoam and other lightweight semi-rigid materials. The honeycombed material preferably includes a plurality of upright, hexagonal sided, tubular members, e.g., tubular member 149, having an axis of symmetry 150 with a perpendicular orientation relative to the planar surface of board 138. Outer layer 151 surrounds voting panel 24 on all sides except the uppermost side that presents switch 126, and is preferably made of aluminum or ABS plastic.

Figure 5:
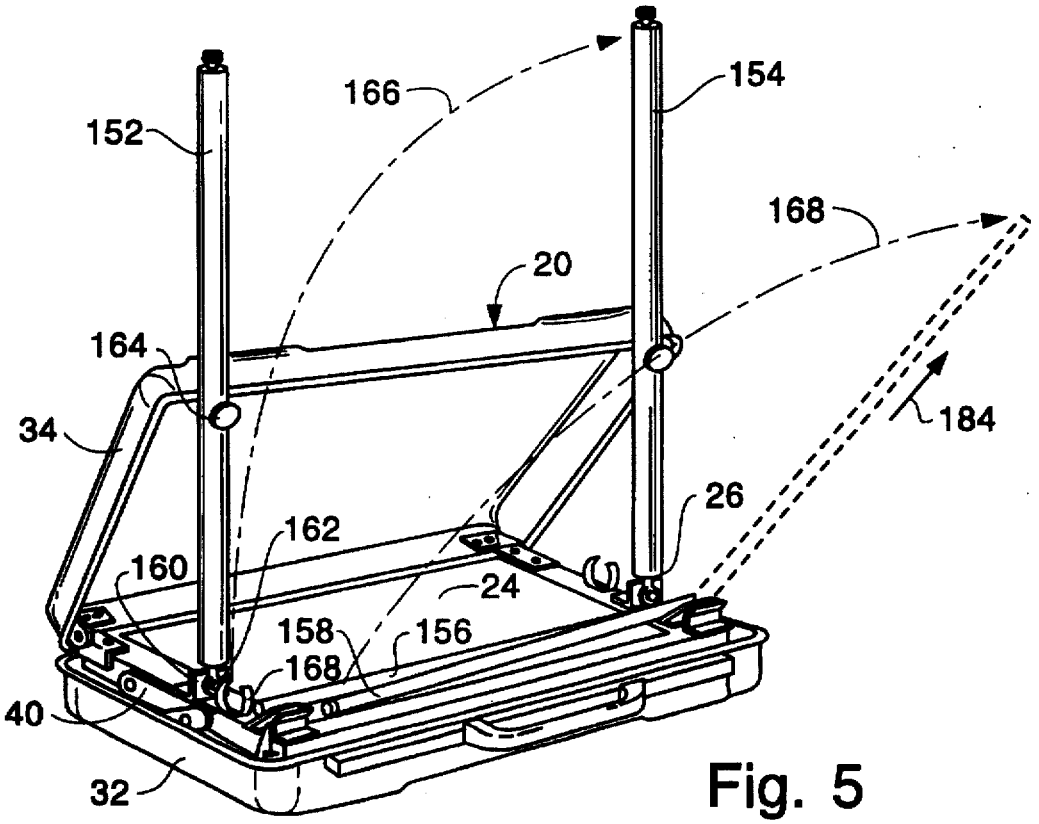
FIG. 5 depicts a left front perspective view of the FIG. 1 booth in an intermediate stage of assembly between the configurations of FIG. 1 and FIG. 2.

FIG. 5 depicts bottom support assembly 26. Assembly 26 includes tubular rear legs 152 and 154, as well as front legs 156 and 158. Pivotable rear leg 152 is loosely pinned or bolted to rear leg mounting bracket 160 at eye bolt 162. Bracket 160, in turn, is bolted to the voting panel 24. Rear leg 152 receives threaded member 164, which passes through leg 152 and into a corresponding threaded opening in lower shell 34 for locking leg 152 into position relative to shell 34. Leg 154 is a mirror image of leg 152, and pivots along arc 166 between the extended position of FIG. 5, and an unextended position where it is retained against panel 24 by spring metal clip 168. Similarly, front leg 158 pivots outwardly along arc 168. Leg 158 in the extended position preferably ranges from about thirty-five degrees to fifty degrees, and most preferably forty-five degrees, relative to a horizontal plane defined by voting panel 24. Legs 156 and 158 are preferably separated by three feet or more across the width of panel 24, as are legs 152 and 154, in order to permit the passage of a wheelchair (not depicted in FIG. 5) therebetween.

Figure 6:
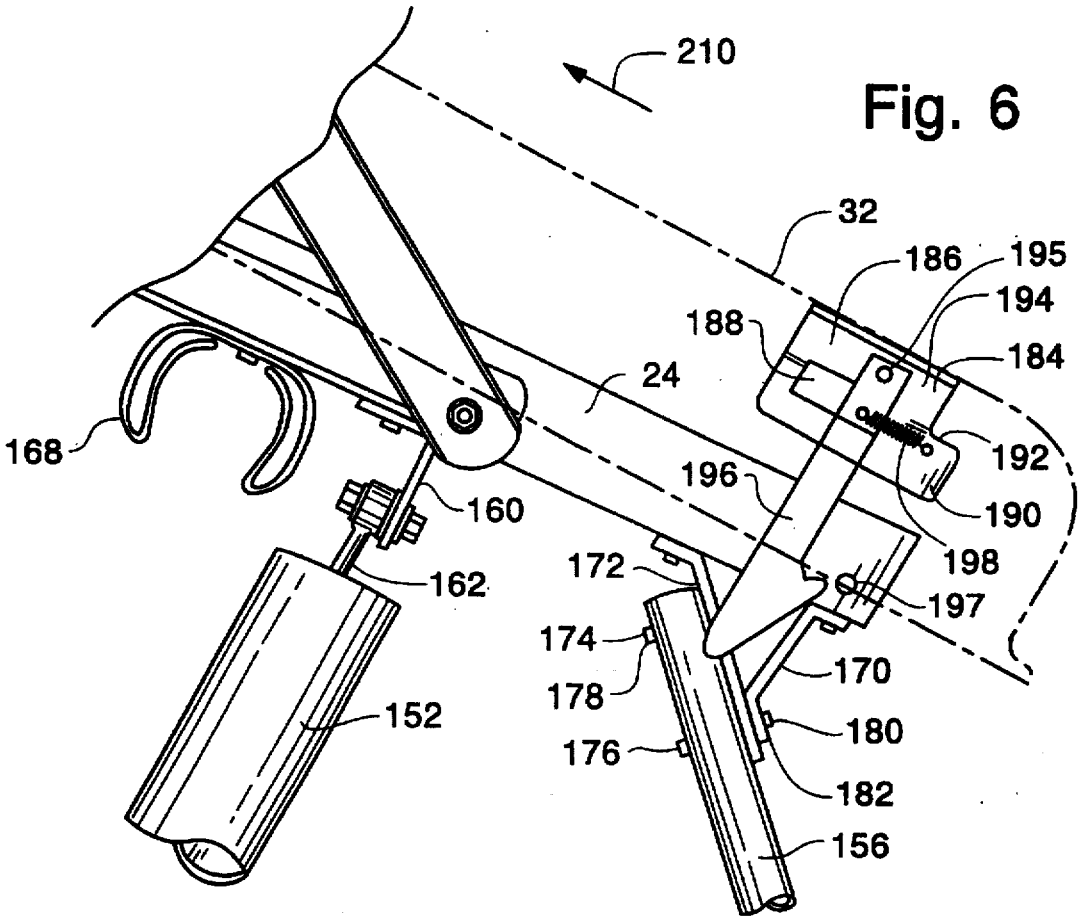
FIG. 6 depicts a support base and a floating latch mechanism for use in the booth of FIG. 1.

FIG. 6 depicts a preferred manner of connecting tubular leg 156 to voting panel 24. Right angle brace 170 is bolted to panel 24, and presents a forty-five degree hypotenuse member 172. Leg 156 is apertured to receive bolts 174 and 176, which are connected by an interior tension coil spring 177 (see FIG. 7) within tubular leg 156. Spring 177 biases bolt 174 toward bolt 176. Bolt 174 passes through hypotenuse member 172 and through leg 156. Leg 156 is provided with a pair of longitudinally elongated obround slots, e.g., rearward slot 175 (see FIG. 7).

Figure 7:
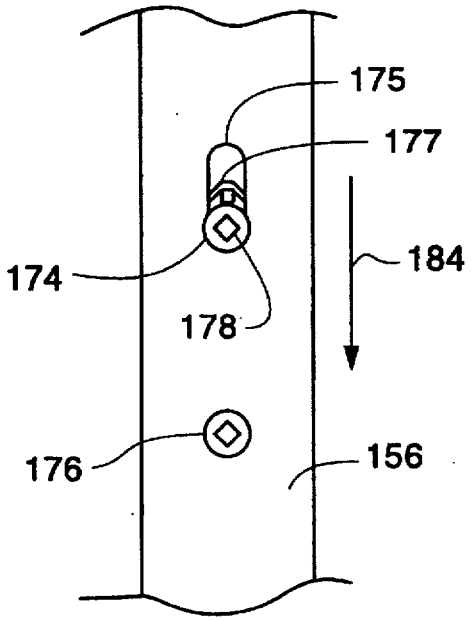
FIG. 7 depicts a rear elevational view that provides additional detail pertaining to the support base of FIG. 6.

FIG. 7 depicts a rear view of bolt 174 as it is shiftably received within slot 175 proximal to rearward end 178 of bolt 174. An identical forward slot exists proximal to the forward end of bolt 174 and remote from end 178. Movement of leg 156 in the direction of arrow 184 will remove bolt 176 from dovetail detent 182 (see FIGS. 6 and 8), and permit pivoting motion of leg 156 around bolt 174.

Figure 8:
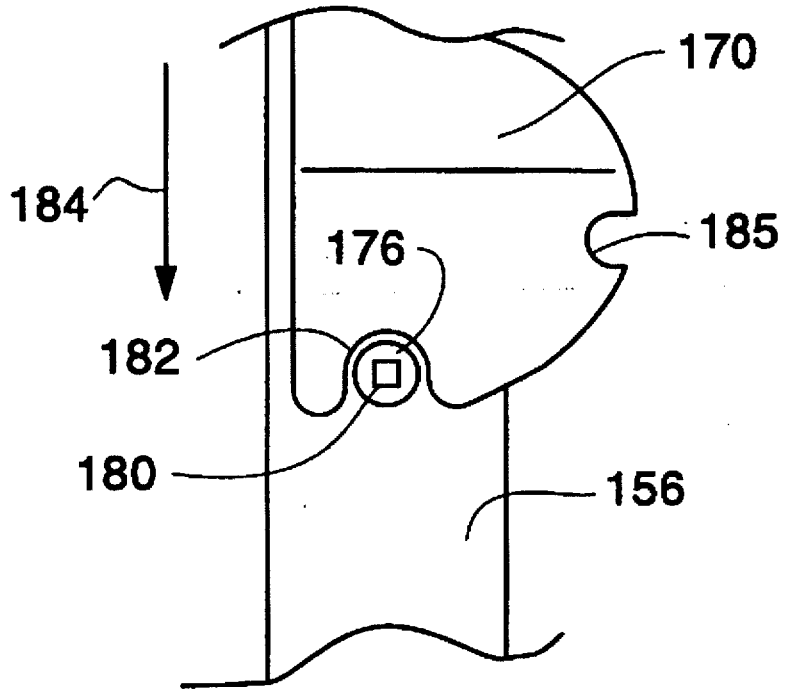
FIG. 8 depicts a front elevational view that provides additional detail pertaining to the support base of FIG. 6.

FIG. 8 depicts a forward end 180 of bolt 176 within dovetail detent 182. Forward end 180 is retained under spring bias within dovetail detent 182. Leg 156 can be pulled in the direction of arrow 184 against the bias of spring 177 (see FIG. 7) and rotated around bolt 174 to a collapsed storage position at a second dovetail detent 185.

FIG. 6 also depicts a floating latch mechanism 184 that is connected to shell member 32. A positional reference to member 32 is indicated by a dashed line, but member 32 is not depicted because it would interfere with the view of mechanism 184. Bracket 186 is riveted to upper shell member 32. Bracket 186 includes a central rectangular opening 188, and a lower sheet portion 190 that is offset to the side with respect to upper sheet portion 194 by a central dog-leg segment 192. Segment 192 and opening 188 permit the passage of hooked locking tongue 196 through opening 188. Tongue 196 is pivotally coupled with portion 194 at rivet 195. Tension spring 198 biases tongue 198 in a forward direction that fails to travel forwardly a sufficient distance for the engagement of tongue 196 with pin 197. Pin 197 extends outwardly to the side of voting panel 24 a sufficient distance to engage tongue 196.

FIG. 1 depicts curtain rod assembly 28. Assembly 28 includes a plastic or nylon privacy curtain 200 that is hung from a plurality of curtain rings, e.g., ring 202, that are disposed around rod assembly 204. As depicted, rod assembly 204 includes a plurality of telescoping rod members, e.g., member 206, with each forward member in succession having a narrowed diameter for receipt within the preceding rearward members. Thus, rod assembly 204 can be collapsed by pushing inwardly on a forward U-tube segment 208. The mounting brackets, e.g., bracket 41, can collapse to bring rod assembly downward relative to shell member 32 for storage of rod and curtain assembly 28. Rod assembly members such as members 206 and 208 need not be telescoping members, and can alternately have male-female connections leading to tubes of the same diameter (not depicted). The respective same-diameter tubes can be connected in sequence by an interior shock chord. Booth 20 is preferably about six feet tall at handle 40. In the extended position of FIG. 1, rod assembly 204 preferably inclines toward the front of booth 20 at an angle ranging from ten to thirty degrees up from horizontal. This angle of incline permits a voter who is taller than the height of handle 40 to pass underneath rod assembly 204 without having to duck his or her head.

In operation, when booth 20 is opened to the voting configuration as depicted in FIG. 1, person 30 can push front end 212 of wheel chair 214 between front legs 156 and 158, as well as between rear legs 152 and 154. Person 30 can pull curtain 200 around rod assembly 204 for compartmental privacy while he or she accesses booth 20 from a frontal position, i.e., person 30 faces the front end of booth 20 while voting. Despite the fact that person 30 is in a seated position, he or she can see voting instructions on declined sheet 56. Declined ballot sheet 120 on voting panel 24 is also visible to person 30.

Several features of booth 20 facilitate access to booth 20 by both persons who are wheel-chair bound and standing persons. These features significantly enhance accessibility for wheelchair-bound persons while not interfering with the voting operations of standing persons. The five to fifteen degree angle of declination for wall 54 permits person 30 to read instructions 56, however, the angle is not so severe that it interferes with the voting of another person standing in place of person 30. The thirty to fifty degree declination of voting panel 24 similarly permits person 30 to read ballot sheet 120 without interfering with the voting of another person standing in place of person 30. The front end of panel 24 is preferably positioned at a height ranging from two to three feet above the floor, and this height is most preferably about two and one-half feet. This height will place the front end of panel 24 at about the chest of a seated person, e.g., person 30, and at about the waist of a person standing in place of person 30. The width separation that separates legs 156 and 158 permits the passage of wheelchair 198 beneath panel 24, and significantly increases the ability of person 30 to reach the entirety of ballot 120.

Sensory circuit 105 determines when person 30 has made a closed-circuit contact between rings 130 and 134 by depressing an LED indicator switch, e.g., switch 126, and relays this positional information to CPU 102. CPU 102 responsively causes driver 103 to energize LED 146 for the emission of visible light as an indicator that switch 126 has been depressed. CPU 102 includes a memory register that tracks the status of all LED indicators. LED 146 will, accordingly, be deactivated in the event that switch 126 is depressed after it has been previously energized. Deactivation serves as an indicator that the balloting selection has been withdrawn. Deactivation of LED 146 will also occur if person 30 selects a second button from within a mutually exclusive group of choices determined by the programming of CPU 102, e.g., as when person 30 selects candidate A and then candidate B within a single election between candidates A and B. The candidate A indicator will deactivate and the candidate B button will activate. Ballot sheet 120 is specially printed to conform to the dimensions of panel 24. Thus, during the election CPU 102 will lock out any LED switch indicators that do not correspond to ballot selections. Alphanumeric panel 108 is accessed after depressing write-in button 110, in order to identify a write-in candidate. LCD display 110 provides voting instructions and interacts with the voter, e.g., person 30. Help button 114 is used to begin an interactive help program that in LCD display 11he voter through LCD display 112.

Figure 9:
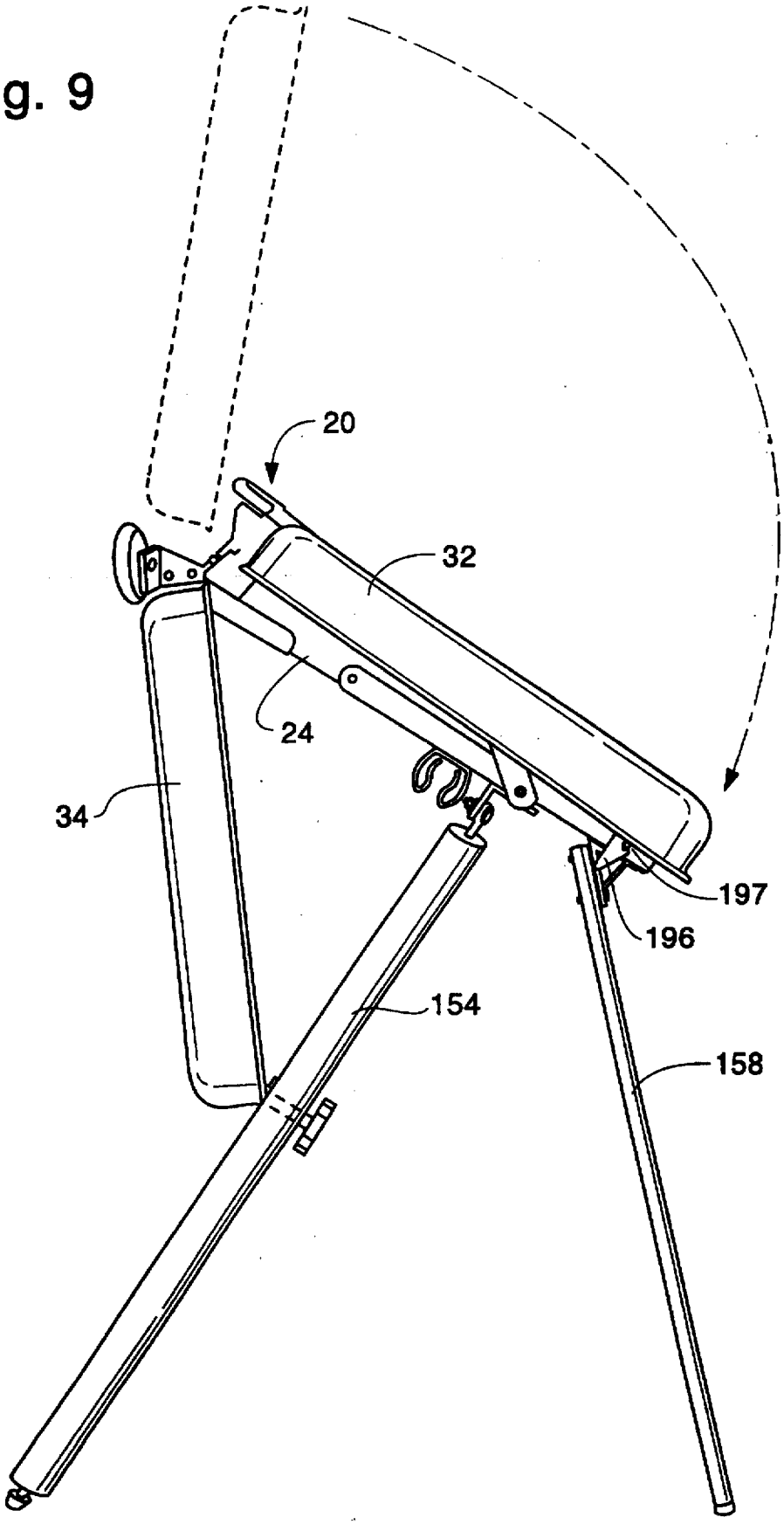
FIG. 9 depicts a left side elevational view of the FIG. 1 booth in an intermediate stage of assembly between the FIG. 1 configuration and the FIG. 5 configuration.

At the conclusion of the election, booth 20 is disconnected from CPU 102 and driver 103. Rod and curtain assembly 28 is telescopically collapsed for receipt within compartment area 60 of shell member 32. Shell member 32 is then collapsed to meet voting panel 24 as depicted in FIG. 9 with latch tongue 196 not engaging pin 197. Booth 20 is next picked up and inverted with shell member 32 resting on the ground. The respective legs rise upwardly in this orientation as depicted in FIG. 5. Leg 156 is pulled in the direction of arrow 184 to release bolt 176 from dovetail detent 182 (or its counterpart for leg 158), and pivoted as along an arc like arc 168 to the collapsed storage position depicted in FIG. 5. In this position, forward end 1809 of bolt 176 is received in dovetail detent 185 under the bias of spring 177 (see FIGS. 7 and 8). Threaded fastener 164 is removed, and leg 152 is pivoted along arc 166 to a collapsed storage position where it is retained by a spring clip like clip 168. Thereafter, shell member 34 is lowered to meet member 32. The corresponding downward pivoting motion of shell member 34 pulls against hinge 37 to shift panel 24 rearwardly in the direction of arrow 210 (see FIG. 6) for locking engagement with tongue 196. The length of the shifting motion along arrow 210 is controlled by the distance between the offset axes passing through the first pair of hinges including hinge 36 and the second pair of hinges including hinge 37. Latches 74 and 76 are locked to provide the storage and transport configuration for booth 20 as depicted in FIG. 2. A plurality of booths 20 can be stacked one atop the other with minimal waste of space. Additionally, the total weight of booth 20 preferably does not exceed about fifty pounds for easy handling. Booth 20 more preferably does not exceed thirty-five pounds in weight.

In the process of preparing for an election, lower shell member 34 can be positioned on the ground, and upper shell member 32 can be opened by releasing latches 74 and 76. Pivoting motion of upper shell member 32 does not cause shifting of voting panel 24 relative to lower shell member 34 and, consequently, tongue 196 says engaged with pin 197. In this configuration, lid 88 can be raised for the renewal of ballot sheet 120. Lid 88 is subsequently lowered, and latches 74 and 76 are fastened prior to transportation of booth 20 to a polling place.

Those skilled in the art will understand that the preferred embodiments, as hereinabove described, may be subjected to apparent modifications without departing from the true scope and spirit of the invention. Accordingly, the inventors hereby state their intention to rely upon the Doctrine of Equivalents, in order to protect their full rights in the invention.

What is claimed is:

1. A portable voting booth accessible for use by a wheelchair-bound person comprising:

a bivalve case including an upper shell member and a lower shell member and having an open configuration when said booth is used by said person to cast a ballot and a closed configuration for transportation of said booth, said case enclosing an interior compartment within said upper shell and said lower shell when said case is in said closed configuration;

a voting panel coupled with said bivalve case and having dimensions corresponding to said compartment for receipt therein when said case is in said closed configuration, said voting panel presenting a frontal access position to access a ballot-casting surface on said voting panel; and a support base including a plurality of legs that are vertically rising when said case is in said open configuration;

said support base including connecting and folding means for connecting said legs to said support base to permit passage of a front portion of a wheelchair between a pair of said legs for frontal access to said ballot-casting surface by said persona when casting a ballot at said voting panel when said case is in said open configuration, and for folding said pair of said legs to positions for being received within said compartment when said case is in said closed configuration.

2. The booth as set forth in claim 1, said legs support said voting panel with said ballot-casting surface disposed at an angle ranging from forty to fifty degrees relative to vertical when said case is in said open configuration for voting.

3. The booth as set forth in claim 1, said connecting and folding means including a first leg connector on a first side of said voting panel and a second leg connector on a second side of said voting panel remote from said first side, said first leg connector and said second leg connector being separated a sufficient horizontal distance across said panel to permit said person to pass said frontal portion of said wheelchair underneath said voting panel between a first of said legs connected to said first leg connector and a second of said legs connected to said second leg connector.

4. The booth as set forth in claim 3, wherein said sufficient horizontal distance exceeds about three feet at vertical top ends of said first and second of said legs when said case is in said open configuration.

5. The booth as set forth in claim 3, said first leg connector and said second leg connector each including a detent and a protrusion, said protrusion being shiftable relative to said detent for engagement and disengagement between said protrusion and said detent.

6. The booth as set forth in claim 5, said first leg connector and said second leg connector each having a spring biasing said protrusion into engagement with said detent.

7. A portable voting booth comprising, a bivalve case including an upper shell member and a lower shell member, said case having an open configuration when said booth is made ready for casting ballots and said case having a closed configuration for transportation of said booth, said case enclosing an interior compartment within said upper shell and said lower shell when said case is in said closed configuration;

a voting panel coupled with said case and being received within said compartment when said case is in said closed configuration, said voting panel presenting a frontal access position to access a ballot-casting surface on said voting panel; and a support base including a plurality of legs that, when said case is in said open configuration, are vertically rising and support said case and said voting panel;

said support base including connecting and folding means for connecting said legs to said support base to permit, when said case is in said open configuration, frontal access to said booth by said person, when casting a ballot at said voting panel, and for folding said legs to positions for being received within said compartment when said case is in said closed configuration; and at least one hinge connecting said shell members and said voting panel.

8. The booth as set forth in claim 7, wherein said at least one hinge includes sliding means for sliding said voting panel along a path of travel relative to said shell members as said shell members are moved between said open configuration and said closed configuration, and locking means for locking said voting panel at a position along said path of travel.

9. The booth as set forth in claim 8 wherein said at least one hinge comprises a first hinge connecting said upper shell member and said lower shell member and said sliding means includes a second hinge connecting said voting panel and said lower shell member.

10. The booth as set forth in claim 9, said first hinge having a first pivot axis, said second hinge having a second pivot axis, said first pivot axis being offset a distance from said second pivot axis.

11. The booth as set forth in claim 1, when said case is in said open configuration, at least one of said legs being engaged with said lower shell member by engaging means for engaging said at least one leg with said lower shell member at a position beneath said voting panel to stabilize said booth, said engaging means not engaging said lower shell member and said at least one leg when said case is in said closed configuration.

12. The booth as set forth in claim 11, said engaging means including a connector that connects said lower shell member to a side of said at least one of said legs.

13. The booth as set forth in claim 1, said voting panel including a computer-controlled LED display for use in indicating choices made on a ballot retained on said ballot-casting surface.

14. The booth as set forth in claim 1 including a rod assembly operably connected to a slidable curtain, said rod assembly being attached to an upper one of said shell members when said case is in said open configuration and having take-down dimensions capable of being received within said compartment when said case is in said closed configuration.

15. The booth as set forth in claim 14 weighing less than about fifty pounds.

16. The booth as set forth in claim 1, including retaining means for retaining said upper shell member in a forwardly tilted position when said case is in said open configuration with said booth made ready for voting, said ballot-casting surface of said voting panel sloping downward toward said frontal access position when said case is in said open position.

17. The booth as set forth in claim 16, said retaining means including a pair of strap arms connecting said voting panel and said upper shell member.

18. The booth as set forth in claim 16, said forwardly tilted position being sufficient to place a rearward wall of said upper shell member at an angle ranging from five to fifteen degrees relative to vertical.

19. A portable voting booth accessible for use by a wheelchair-bound person, the booth including:

a case including a first shell member and a second shell member, said first shell member and said second shell member capable of closing together to enclose an interior compartment between said first shell member and said second shell member;

a voting panel having a ballot-casting surface at which said person casts a ballot when said person is voting at said booth;

a plurality of legs capable of supporting said first shell member, said second shell member and said voting panel in elevated position when said person is casting a ballot at said booth;

said booth having a first, retracted configuration for transportation of said booth, said booth having a second, expanded configuration when said person is casting a ballot at said booth;

when said booth is in said first configuration, all of said voting panel and said legs being received inside of said interior compartment of said case;

when said booth is in said second configuration, said booth having a front for access by said person to said ballot-casting surface to permit said person to cast a ballot on said ballot-casting surface, a pair of said legs closest to said front being horizontally separated at top vertical ends of each of said legs of said pair by a distance that is large enough to permit the width of a wheelchair to pass between said top vertical ends;

all of said first shell member, said second shell member, said voting panel and said legs being connected in a single unit such that said booth is capable of being reconfigured from said first configuration to said second configuration while maintaining connection of said first shell member, said second shell member, said voting panel and said legs in said single unit, whereby said booth may be set up without disconnecting any of said first shell member, said second shell member, said voting panel and said legs from said single unit.

20. The booth of claim 19, wherein:

said legs are pivotally connected with said voting panel to permit folding of said legs for receipt of said legs into said interior compartment when said booth is in said first configuration.

21. The booth of claim 19, wherein:

when said booth is in said second configuration, said first shell member extends in an upward direction relative to said second shell member and said second shell member extends in a downward direction relative to said first shell member;

said pair of said legs being a first pair of said legs, a second pair of said legs being engaged with said second shell member at a location on each of said legs of said second pair that is below the top vertical ends of said legs of said second pair, so that said second shell member acts as a cross-member between said legs of said second pair to stabilize said booth when said booth is in said second configuration.

22. The booth of claim 19, wherein:

when said booth is in said second configuration, said ballot-casting surface of said voting panel slopes downward toward said front of said booth, whereby said wheelchair-bound person may more easily access all portions of said ballot-casting surface.

23. The booth of claim 22, wherein:

when said booth is in said second configuration, said ballot-casting surface of said voting panel slopes downward toward said front at an angle, relative to horizontal, of from about 35 degrees to about 50 degrees.

24. The booth of claim 22, wherein:

when said booth is in said second configuration, said first shell member rises vertically above said voting panel on a side of said booth opposite said front, a surface of said shell member facing said front sloping upward toward said front for ease of reading, by said wheelchair-bound person, of voting information that may be posted on said surface.

25. The booth of claim 19, wherein:

said booth comprises a curtain assembly including a curtain for concealing said wheelchair-bound person when said wheelchair-bound person is situated at the front of said booth, to provide privacy to said person when casting a ballot;

said curtain assembly being connected with said first shell member, said second shell member, said voting panel and said legs in said single unit;

said curtain assembly capable of being collapsed to a size that is small enough to be disposed inside of said interior compartment when said booth is in said first configuration and said curtain assembly capable of being expanded to a size capable of concealing said person when said person is casting a ballot at said booth.

* * * * *

UNITED STATES PATENT AND TRADEMARK OFFICE

CERTIFICATE OF CORRECTION

PATENT NO. : 5,666,765

DATED : September 16, 1997

INVENTOR(S) : SARNER et al.

It is certified that error appears in the above-identified patent and that said Letters Patent is hereby corrected as shown below:

At Column 8, Claim 7, line 37, the text "persona" has been amended to read --person,--

Signed and Sealed this

Twenty-fifth Day of November, 1997

*Attest:*

Bruce Lehman

BRUCE LEHMAN

*Attesting Officer*

*Commissioner of Patents and Trademarks*